US007776173B2

(12) United States Patent
Schumacher et al.

(10) Patent No.: US 7,776,173 B2
(45) Date of Patent: Aug. 17, 2010

(54) ADHESIVE DISPENSING SYSTEM

(75) Inventors: Michael John Schumacher, Hilliard, OH (US); Dana Conover, Dublin, OH (US); Michael Parrish, Westerville, OH (US); Mark William Anders, Hong Kong (CN); Kevin O'Doherty, Hong Kong (CN); Joshua Michael Broehl, Worthington, OH (US); Donald James Staufenberg, Dublin, OH (US); James Huang Lua, Columbus, OH (US); Ryan S. Crisp, Lewis Center, OH (US)

(73) Assignee: Elmer's Products, Inc., Columbus, OH (US)

( * ) Notice: Subject to any disclaimer, the term of this patent is extended or adjusted under 35 U.S.C. 154(b) by 951 days.

(21) Appl. No.: 11/381,597

(22) Filed: May 4, 2006

(65) Prior Publication Data

US 2008/0223511 A1 Sep. 18, 2008

Related U.S. Application Data

(60) Provisional application No. 60/677,968, filed on May 5, 2005.

(51) Int. Cl.
*B32B 15/00* (2006.01)

(52) U.S. Cl. ..... 156/230; 156/247; 156/249; 156/540; 428/40.1

(58) Field of Classification Search ..... None
See application file for complete search history.

(56) References Cited

U.S. PATENT DOCUMENTS

| | | | | |
|---|---|---|---|---|
| 3,852,140 | A * | 12/1974 | Jenkins | 156/253 |
| 5,316,613 | A * | 5/1994 | Samuelson et al. | 156/540 |
| 6,428,225 | B1 * | 8/2002 | Nguyen et al. | 400/613 |
| 6,599,363 | B2 * | 7/2003 | Narita | 118/76 |
| 6,640,864 | B2 | 11/2003 | Downs | |
| 6,686,016 | B2 | 2/2004 | Downs | |

* cited by examiner

*Primary Examiner*—Philip C Tucker
*Assistant Examiner*—Kimberly K McClelland
(74) *Attorney, Agent, or Firm*—McNees Wallace & Nurick

(57) ABSTRACT

A system for dispensing adhesive onto a surface is provided. This system includes a dispenser and a quantity of discrete units of adhesive releasably deposited on a substrate. The dispenser includes a drive mechanism that further includes an actuator for actuating the dispenser; and a drive wheel, wherein the drive wheel further includes mechanical means for engaging the actuator. An optional supply wheel may be included in the dispenser. The quantity of discrete units of adhesive is releasably deposited on a substrate that may be mounted on the supply wheel or that may simply sit within the dispenser. The substrate further includes means for cooperating with the drive wheel to incrementally advance the substrate a substantially fixed, and predetermined distance upon actuation of the dispenser.

9 Claims, 10 Drawing Sheets

ADHESIVE DISPENSING SYSTEM

CROSS REFERENCES TO RELATED APPLICATIONS

This patent application claims the benefit of U.S. Provisional Patent Application Ser. No. 60/677,968 filed on May 5, 2005, and entitled "Adhesive Dot Stamper," the disclosure of which is incorporated by reference as if fully rewritten herein.

BACKGROUND OF THE INVENTION

The described invention relates in general to systems and devices for dispensing adhesive, and more specifically to a system that includes a manually operated, hand-held device that dispenses adhesive or other materials onto a surface.

Individual units of adhesive are known to be useful for temporarily or permanently adhering two objects to one another such as, for example, photographs mounted in a photo album. Due to the increasing popularity of hobbies such as scrap booking, there is a need for improved methods and devices that repeatedly and reliably dispense and apply discrete units of adhesive to a desired surface. Furthermore, there is a need for a system that will dispense adhesive in a manner that does not affect the aesthetic quality of the finished work, i.e., does not result in an uneven adhesion that is visible under or through a photograph or other scrap-booked item. Finally, there is a need for a dispensing device that is ergonomically acceptable and that assists the user of the device in avoiding repetitive motion injuries such as carpal tunnel syndrome or other undesirable conditions.

SUMMARY OF THE INVENTION

The following provides a summary of exemplary embodiments of the present invention. This summary is not an extensive overview and is not intended to identify key or critical aspects or elements of the present invention or to delineate its scope.

In accordance with one aspect of the present invention, a system for dispensing adhesive or other material(s) onto a surface is provided. This system includes a dispenser and a quantity of discrete units of adhesive releasably deposited on a substrate. The dispenser includes a drive mechanism that further includes an actuator for actuating the dispenser; a unidirectional drive wheel, wherein the drive wheel further includes mechanical means for engaging the actuator and mechanical means for limiting or preventing unintended rotation of the drive wheel; and a supply wheel that includes mechanical means for selectively preventing unintended rotation of the supply wheel after adhesive has been deposited. The quantity of discrete units of adhesive is releasably deposited on a substrate that is mounted on the supply wheel, which is adapted to receive the substrate. The substrate further includes mechanical means for cooperating with the drive wheel to incrementally advance the substrate a substantially fixed, predetermined distance upon actuation of the dispenser.

In accordance with another aspect of the present invention, a device for dispensing discrete units of adhesive or other material(s) onto a surface is provided. This device includes an external housing, a drive mechanism, and an optional supply wheel. The drive mechanism is partially contained within the housing and further includes a depressible plunger; a drive bar mechanically coupled with the plunger; and a drive wheel mechanically coupled with the drive bar, wherein the drive wheel further comprises multiple pairs of tractive cogs or pins. The optional supply wheel is mounted within the housing.

In yet another aspect of this invention, a method for dispensing discrete units or subunits of adhesive or other material(s) onto a surface is provided. This method includes placing a supply roll in a dispenser, wherein the dispenser includes some or all of the features described above, placing the plunger against a surface; and applying downward force on the dispenser sufficient to actuate dispenser and deposit a unit of adhesive or other material.

Additional features and aspects of the present invention will become apparent to those of ordinary skill in the art upon reading and understanding the following detailed description of the exemplary embodiments. As will be appreciated, further embodiments of the invention are possible without departing from the scope and spirit of the invention. Accordingly, the drawings and associated descriptions are to be regarded as illustrative and not restrictive in nature.

BRIEF DESCRIPTION OF THE DRAWINGS

The accompanying drawings, which are incorporated into and form a part of the specification, schematically illustrate one or more exemplary embodiments of the invention and, together with the general description given above and detailed description given below, serve to explain the principles of the invention, and wherein.

DETAILED DESCRIPTION OF THE INVENTION

Figure 1:
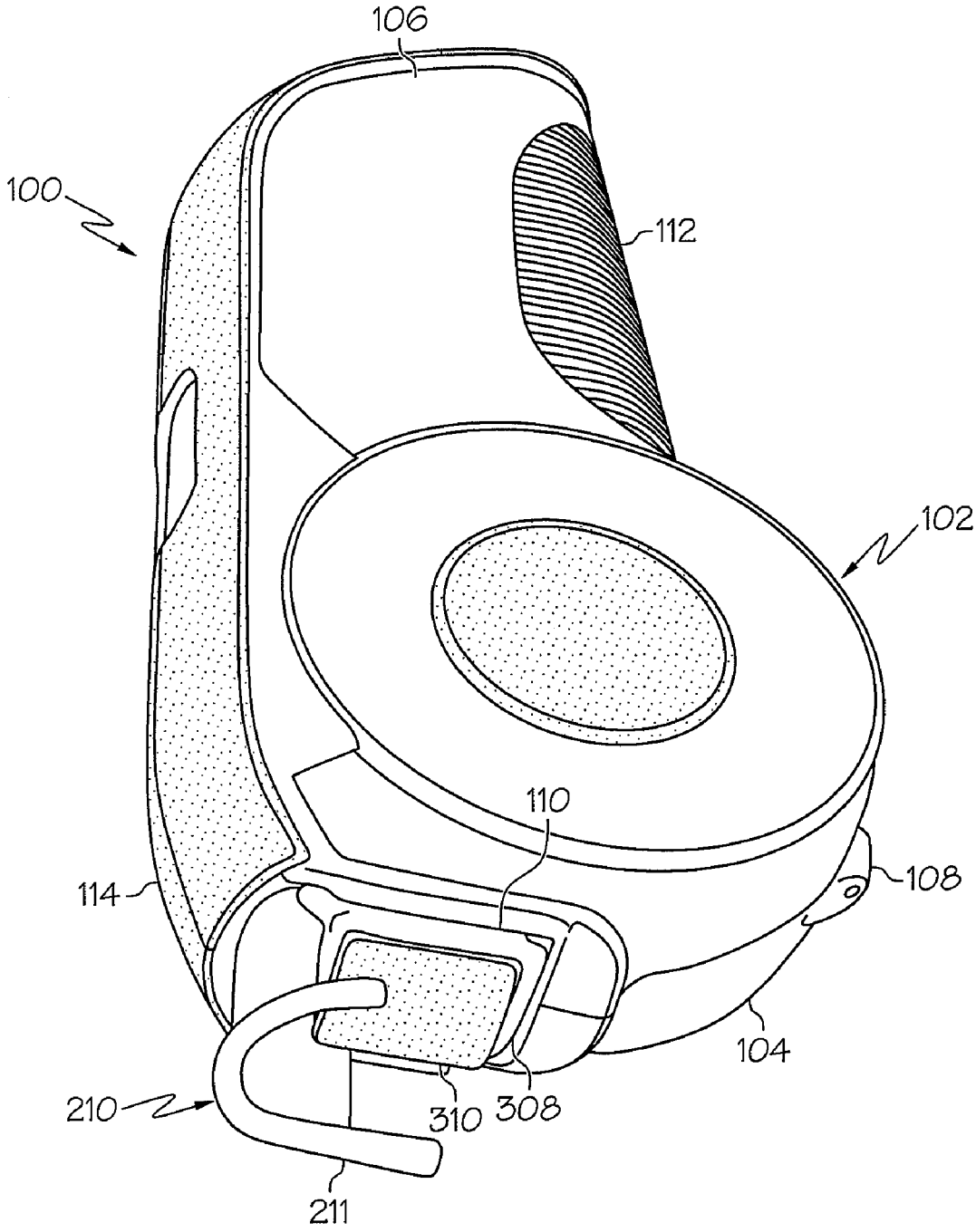
FIG. 1 is a front perspective view of an exemplary embodiment of the hand-held adhesive dispenser of the present invention.

Exemplary embodiments of the present invention are now described with reference to the Figures. Reference numerals are used throughout the detailed description to refer to the various elements and structures. Although the following detailed description contains many specifics for the purposes of illustration, anyone of ordinary skill in the art will appreciate that many variations and alterations to the following details are within the scope of the invention. Accordingly, the following embodiments of the invention are set forth without any loss of generality to, and without imposing limitations upon, the claimed invention.

The present invention relates to an adhesive dispensing system. A first general embodiment of this invention provides a system for dispensing adhesive onto a surface, which includes a dispenser and a quantity of discrete units of adhesive releasably deposited on a substrate in the form of a length of tape. The dispenser includes a drive mechanism that further includes an actuator for actuating the dispenser; a unidirectional drive wheel, wherein the drive wheel further includes mechanical means for engaging the actuator; and a unidirectional supply wheel. The quantity of discrete units of adhesive is releasably deposited on a substrate that is mounted on the supply wheel. The substrate further includes mechanical means for cooperating with the drive wheel to incrementally advance the substrate a substantially fixed, predetermined distance upon actuation of the dispenser. A second general embodiment of this invention provides a device for dispensing discrete units of adhesive onto a surface. The device includes a hinged, external housing, a drive mechanism, and a supply wheel. The drive mechanism is contained within the housing and further includes a depressible plunger; a drive bar mechanically coupled with the plunger; and a drive wheel mechanically coupled with the drive bar, wherein the drive wheel further comprises a plurality of tractive cogs or pins; and a supply wheel mounted within the housing. A third general embodiment of this invention provides a method for dispensing discrete units of adhesive onto a surface. This method includes placing a tape supply roll in a dispenser, wherein the dispenser includes features described above, placing the plunger against a surface; and applying downward force on the dispenser sufficient to actuate dispenser and dispense a unit of adhesive.

With reference now to the Figures, an exemplary embodiment of the present invention will be described. FIGS. 1-7 provide various views of adhesive dispending system 10, which typically includes a dispenser 100 and a tape supply roll 400. The dispenser includes an enclosure in the form of a housing 102, a drive system 200, and a shroud 300, each of which will be described in greater detail below, starting with housing 102.

As best shown in FIGS. 1-2, 3A-B and 4A-B, housing 102 includes a first housing portion 104 and a second housing portion 106, which is flexibly attached to first housing portion 104 by hinge 108. Housing 102 may be opened to gain access to the interior of dispenser 100 (see FIGS. 3-4). Housing 102 may be closed by bringing the first and second housing portions together and engaging first clasping member 116 with second clasping member 118 (see FIGS. 1-2). An aperture 110 is formed in the front end of closed housing 102 and provides an opening through which plunger 210 and a portion of shroud 300 extend. A textured, e.g., ribbed, surface 112 is formed on a portion of the exterior surface of housing 112, and together with a non-slip surface 114, which runs the length of one side of housing 102, forms a gripping area on the exterior of dispenser 100. Non-slip surface 114 is typically formed on housing 102 using two-shot injection molding and may include rubber, rubberized plastic, elastomer, or other similar materials. Alternately, non-slip surface 114 may be attached to housing 102 by adhesive means or non-slip surface 114 may be formed directly in the material of housing 102 in a manner similar to that of textured surface 112.

Again with reference to FIGS. 3A-B and 4A-B, the interior of first housing portion 104 includes first post 120, second post 122, third post 124, fourth post 126, fifth post 128 and sixth post 130. These posts serve primarily as mounting points for shroud 300. Sixth post 130 is adapted to receive a screw 314, which secures shroud 300 to housing 102. The interior of housing 102 also includes a plurality of linear guide members. First, second, and third linear guides 133, 134, and 135 are formed on the interior of first housing portion 104 and cooperate with drive bar 220 when dispenser 100 is use. These linear guides also provide some stability to the interior components of dispenser 100. A retainer 136 is formed on the interior surface of first housing portion 104 and provides resistance for a portion of drive system 200 when dispenser 100 is in use. Also formed on the interior of first housing portion 104, is a plurality of supports. First support 140 supports supply wheel 240 and includes retaining means in the form of flanges 142 for securing the supply wheel to support 140. Second support 144 supports drive wheel assembly 250, third support 146 supports rotatable sleeve 270, and fourth support 148 supports take-up wheel assembly 280. Finally, first base member 150 and second base member 152 are formed on the interior of first housing portion 104 and serve as mounting points for first latch 245 and second latch 295, respectively.

Again with reference to 3A-B, 4A-B, 5 and 7, drive system 200 includes an actuator or plunger 210, a drive bar 220, a supply wheel 240, a drive wheel assembly 250, and a take-up wheel assembly 280. When dispenser 100 is in use, plunger 210 contacts the surface upon which a unit of adhesive is to be deposited. When downward pressure is applied, plunger 210 cooperates with the other components of drive system 200 to advance tape 400 though the device. Plunger 210 includes a head 211 and a body 212, in which first slot 213 and second slot 214 are formed. A peg 215 is formed on plunger 210 opposite head 211 and provides support for a first biasing member or spring 229. When dispenser 100 is completely assembled, plunger 210 is mechanically coupled with drive bar 220. In some embodiments, however, plunger 210 and drive bar 220 are a single unitary structure.

Figure 4A:
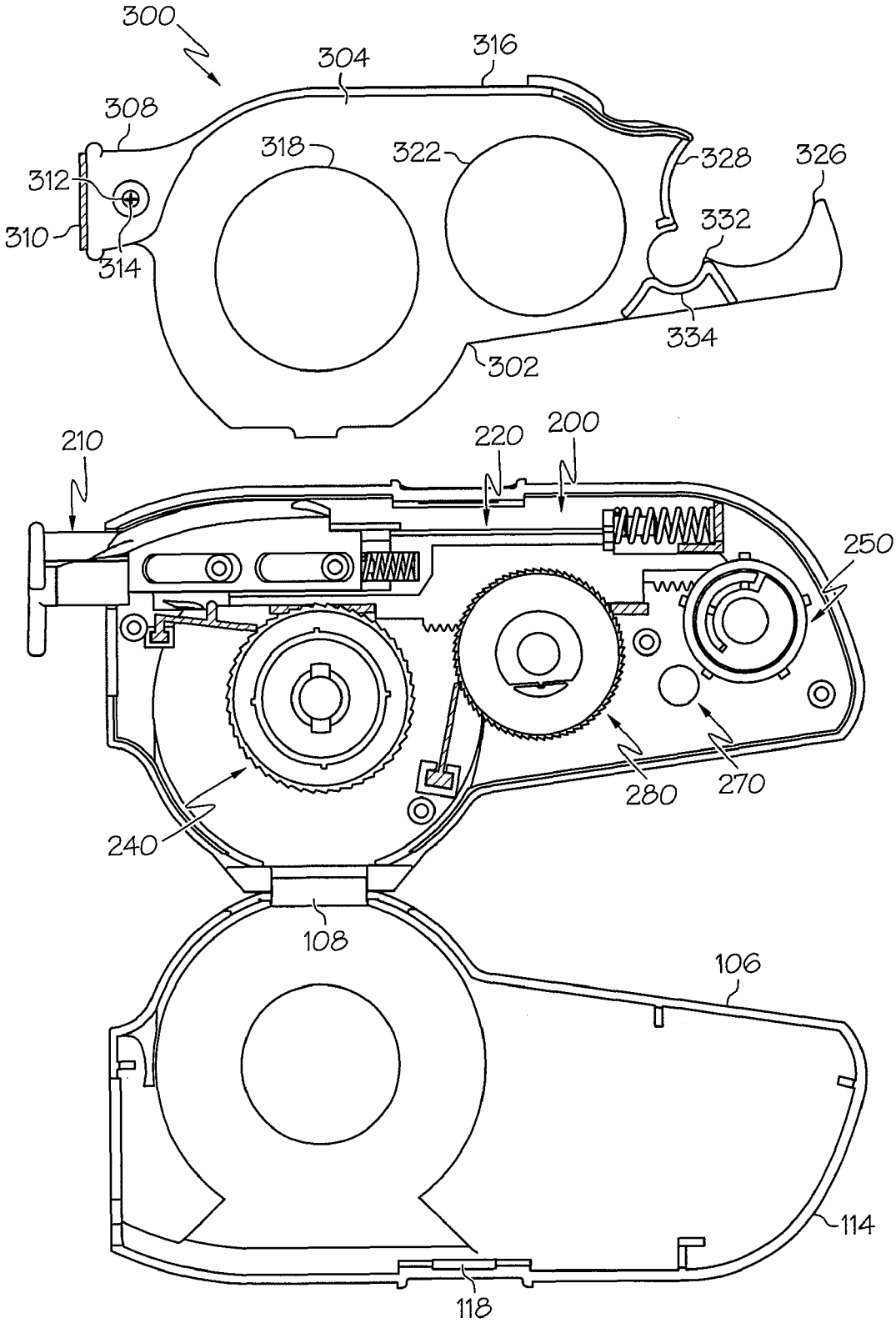
FIGS. 4A-C is a second partially exploded side view of the hand-held adhesive dispenser illustrated in FIG. 1.
Figure 4B:
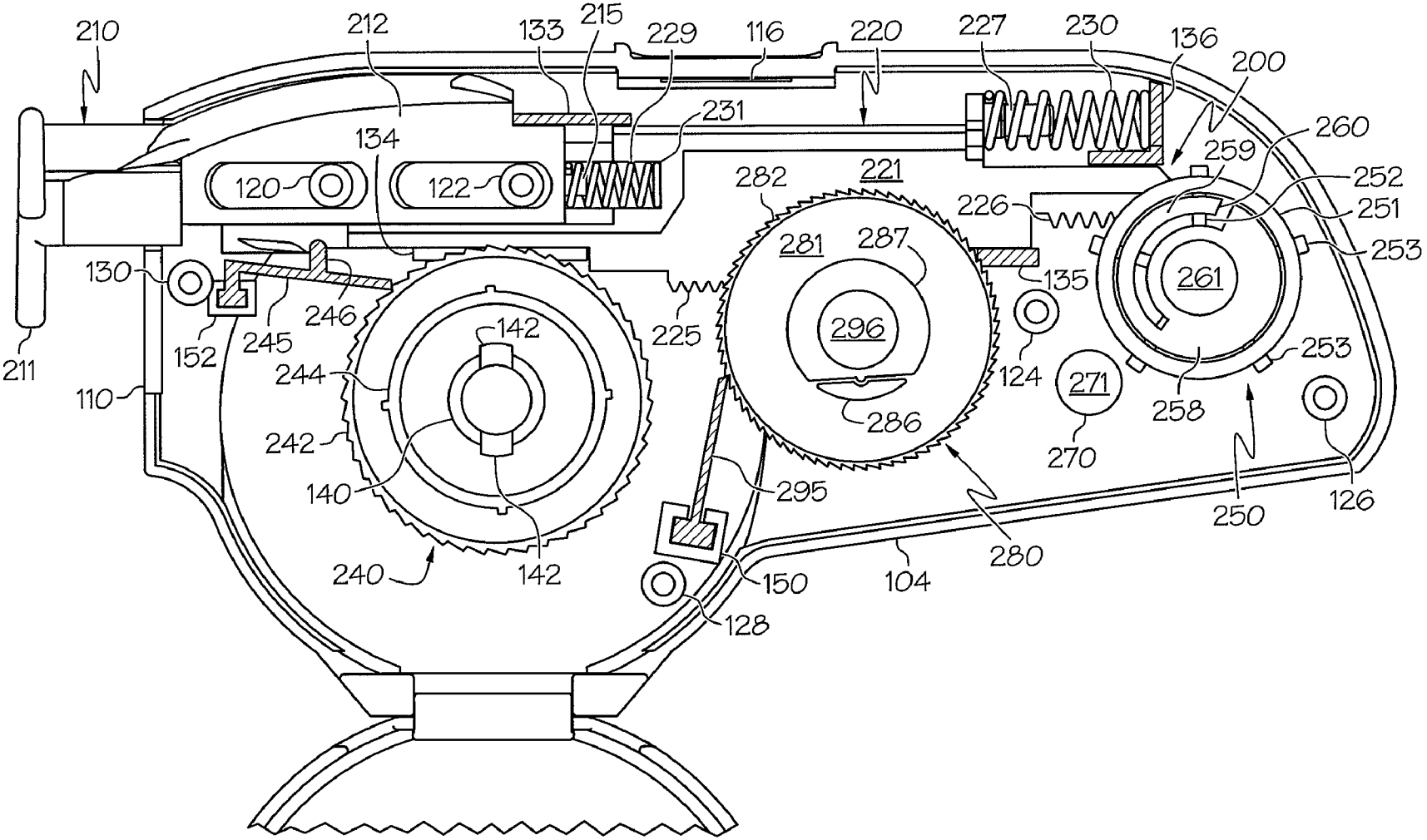
Figure 4C:
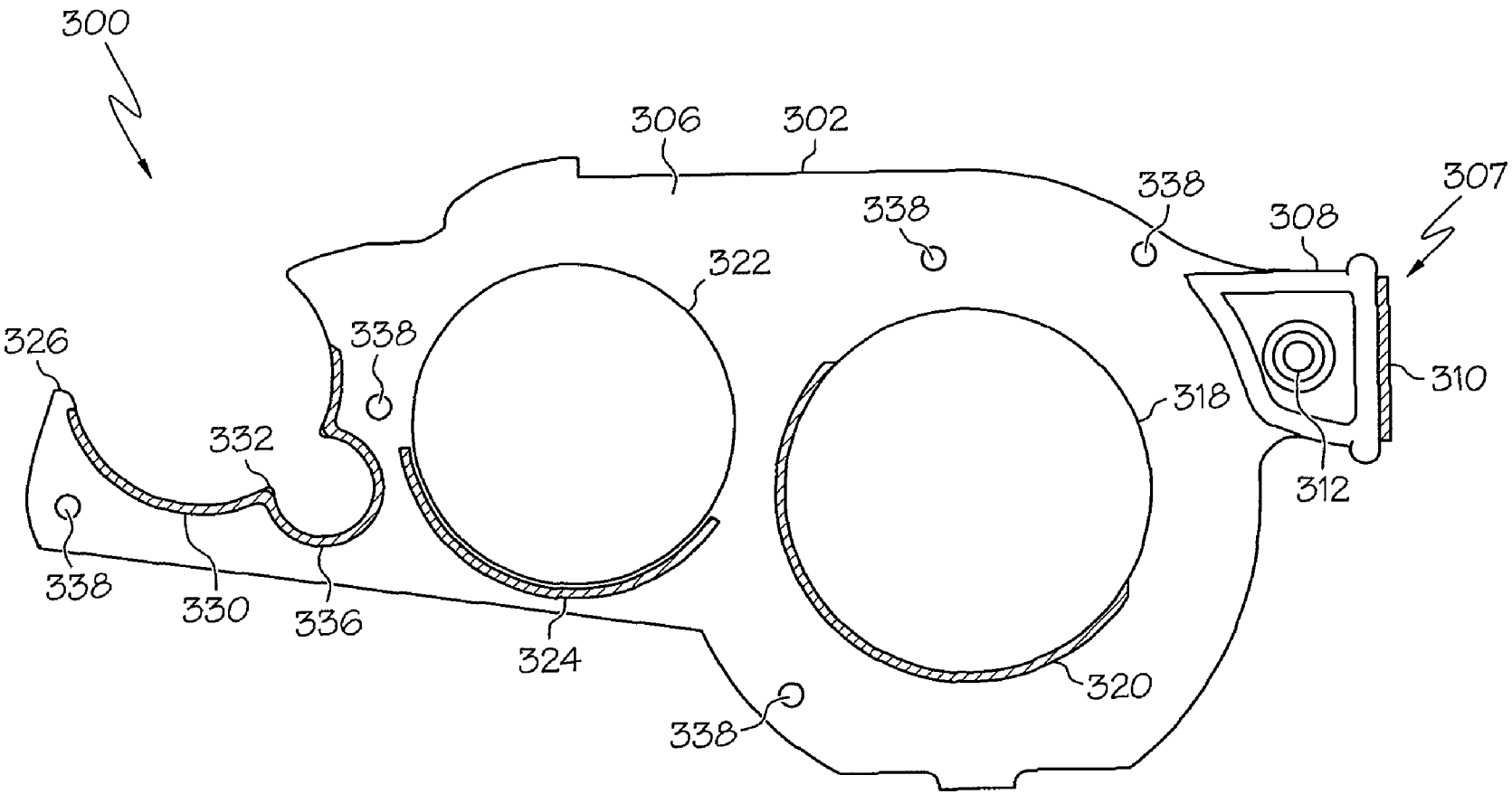

Drive bar 220 includes a body 221, in which a first slot 222 and a second slot 223 are formed. The placement of slots 222 and 223 corresponds to the placement of slots 213 and 214 in plunger 210 when plunger 210 is placed on top of drive bar 220 as shown in FIG. 4A-B. When dispenser 100 is completely assembled, slots 213, 214, 222 and 223 are placed over first and second posts 120 and 122, which generally serve as supports for drive bar 220 and plunger 210 on the interior of housing 102. Track 224, which is formed in body 221, cooperates with the bottom edge plunger 210, and serves as both a support and directional guide for plunger 210 when the plunger is in motion. Drive bar 220 also includes a toothed portion or first gear rack 225 for engaging take-up wheel assembly 280 and another toothed portion or second gear rack 226 for engaging drive-wheel assembly 250. A peg 227 is formed on the rear portion of drive bar 220 and provides support for a second biasing member or spring 230, which acts against retainer 136. A seat 231 is formed in the middle portion of drive bar 220 and provides a surface against which first spring 229 may act. In the exemplary embodiment, first spring 229 acts as a "shock absorber" when dispenser 100 is in use and second spring 230 provides the resistance necessary to return the drive system 200 to the starting position after the dispenser has been actuated. Spring 230 is compressed and returns plunger 210 on each cycle during normal operation. Spring 229 typically provides greater resistance that spring 230. A protrusion 228 is formed near the front portion of drive bar 220 and cooperates with first latch 245 to limit reverse movement of supply wheel 240.

As best shown in FIGS. 3A-B, 4A-B, 5 and 7, supply wheel 240 is attached to first support 140 and provides a location within housing 103 for tape supply roll 400 to be mounted for use. Supply wheel 240 includes a relatively wide base 241 and a cylindrical body 244 for supporting a full roll of tape. As dispenser 100 is actuated, supply wheel 240 rotates in a counter-clockwise direction as a result of the rotation of drive wheel assembly 250. A plurality of ratchet teeth 242 formed on base 241 cooperates with first latch 245, hook 246, and drive bar 220 to prevent counterclockwise rotation of supply wheel 240, thereby preventing the tape on tape supply roll 400 from pulling back out of dispenser 100 when the device is in use. With each actuation of plunger 210, drive system 200 indirectly advances supply wheel 240 one increment, latch 245 temporarily disengages supply wheel 240, and then re-engages supply wheel 240 at the back of another ratchet tooth 242. After removing an empty tape supply roll 400 from dispenser 100, a new tape supply roll may be installed.

Figure 3A:
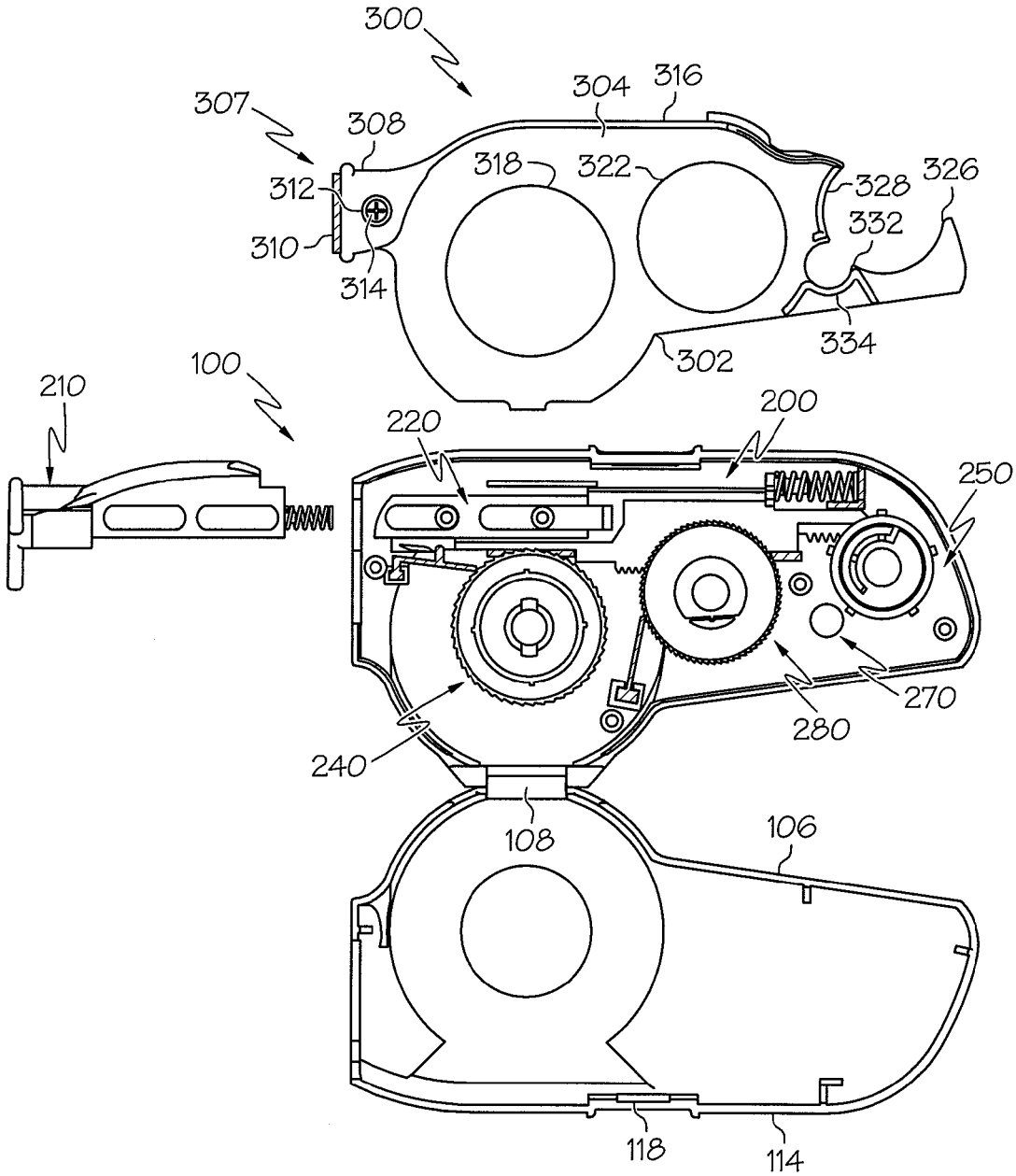
FIGS. 3A-B is a partially exploded side view of the hand-held adhesive dispenser illustrated in FIG. 1.
Figure 3B:
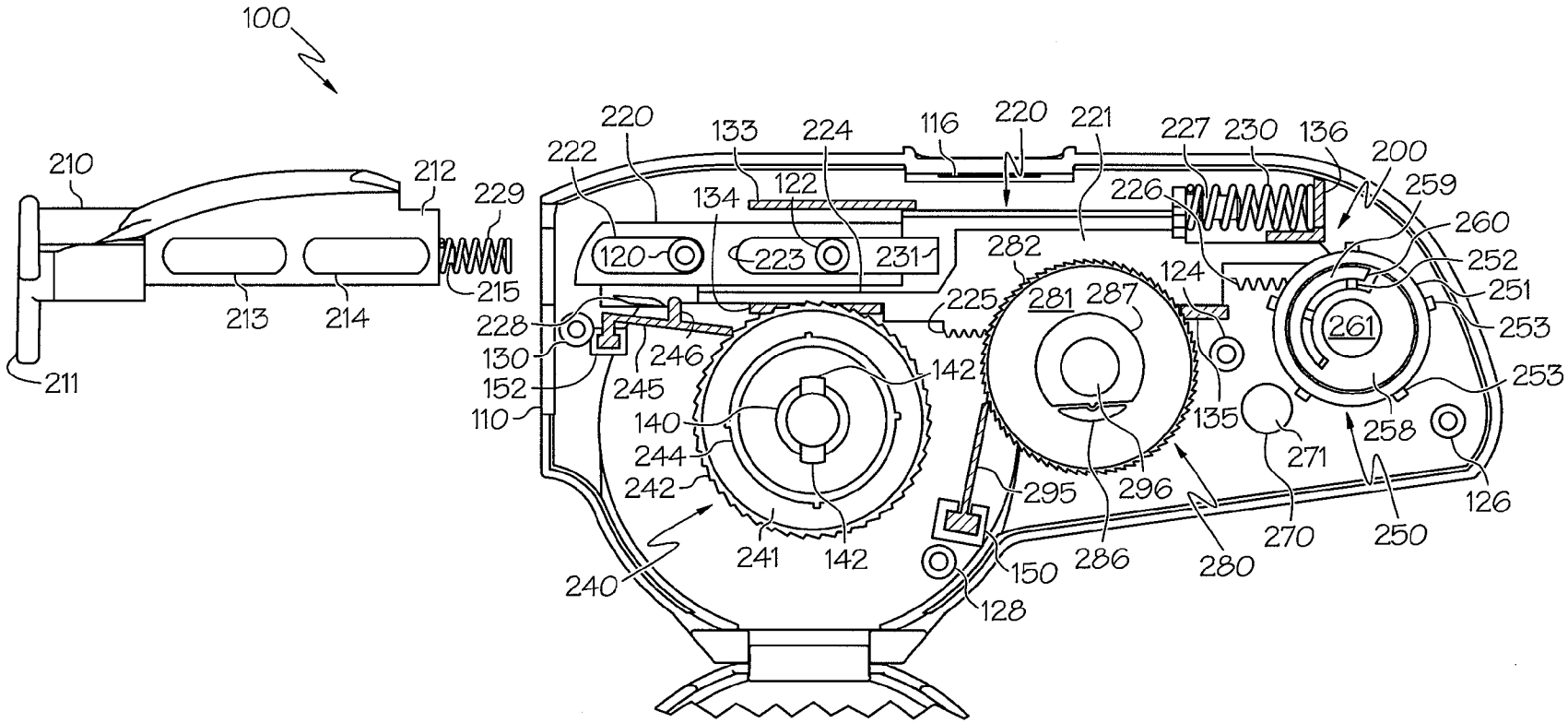
Figure 5:
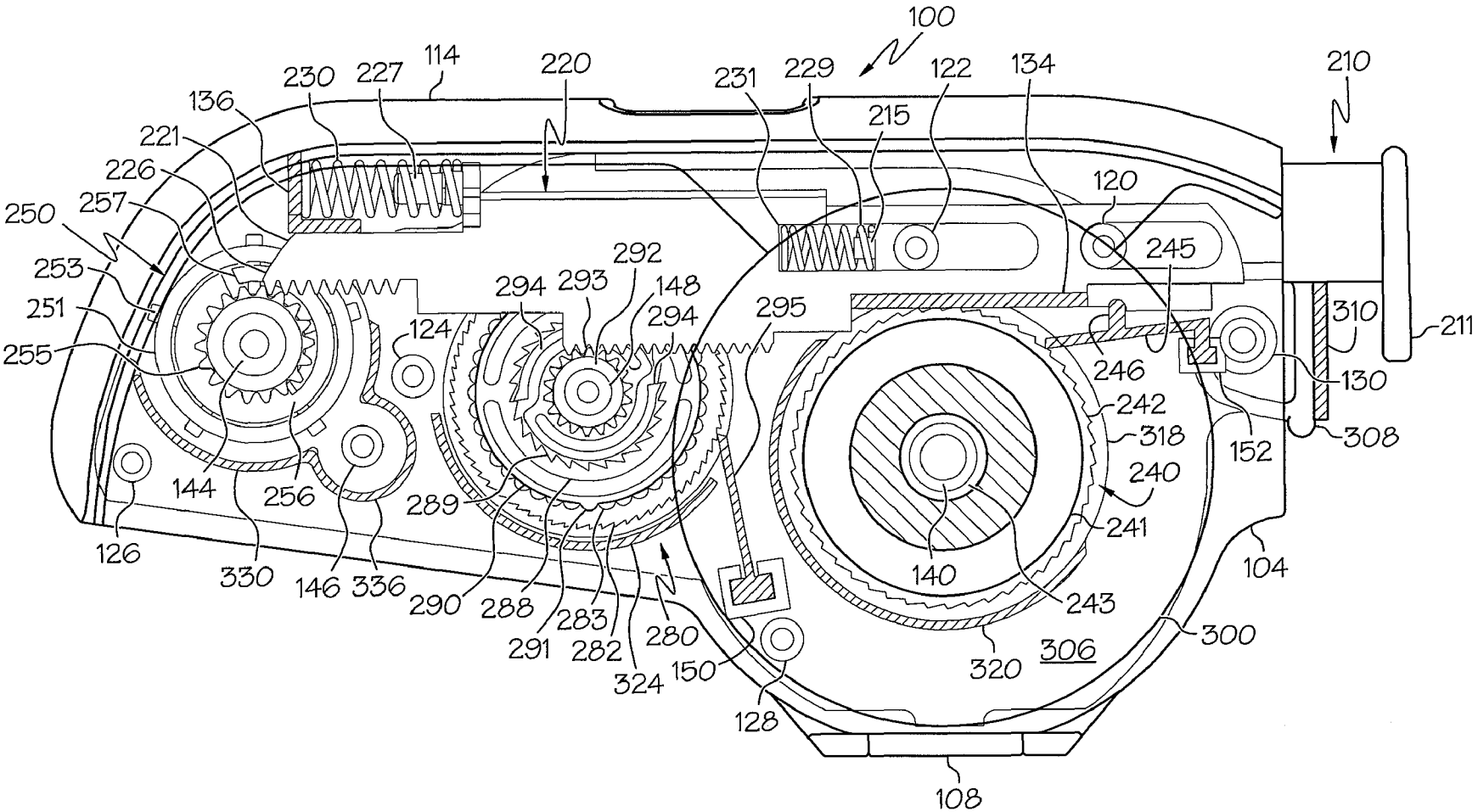
FIG. 5 is a semi-transparent side view of the hand-held adhesive dispenser illustrated in FIG. 1, showing the internal components from the side opposite that shown in FIGS. 3A-B and 4A-B.
Figure 6:
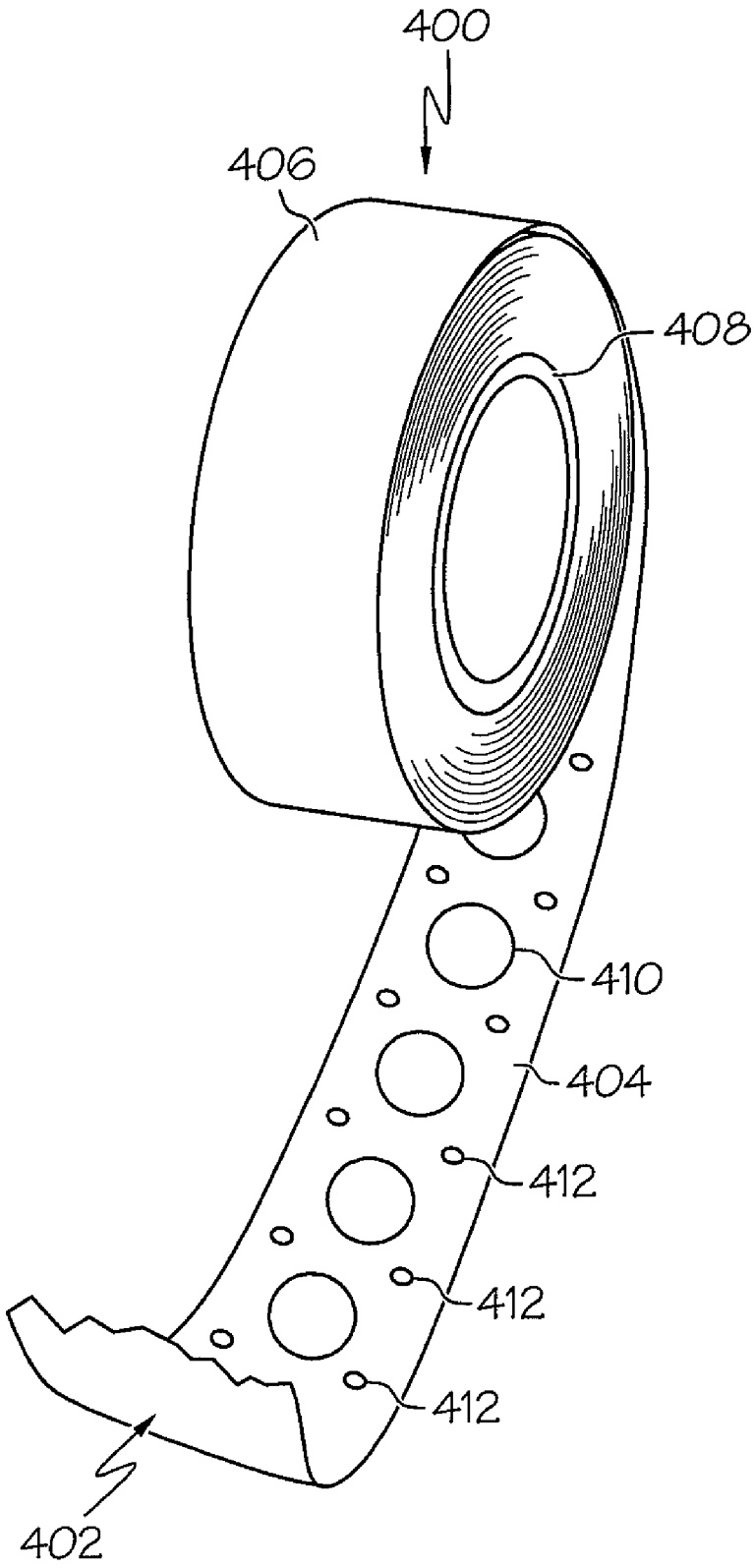
FIG. 6 is a front perspective view of the supply roll component of the hand-held adhesive dispenser illustrated in FIG. 1.
Figure 7:
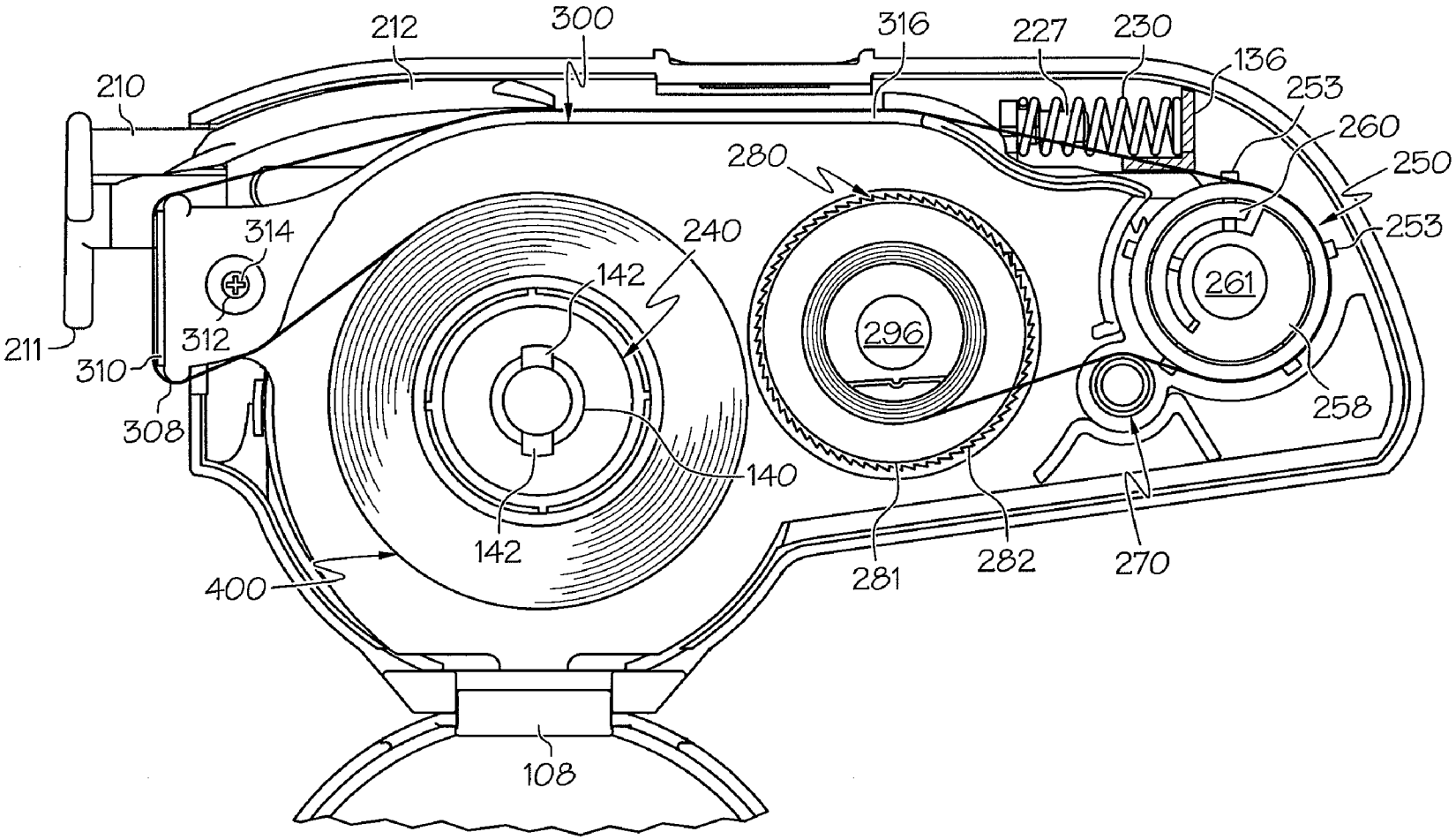
FIG. 7 is an open side view of the internal components of the hand-held adhesive dispenser illustrated in FIG. 1, showing the proper placement of the tape supply roll within the dispenser.

With reference to FIGS. 3B, 5 and 6, drive wheel assembly 250 is mounted on second support 144 and cooperates with drive bar 220 to advance tape supply roll 400 when dispenser 100 is actuated. Drive wheel assembly 250 includes a cylindrical body 251, which includes a plurality of spokes 252 formed therein; a plurality of cogs or tractive pins formed on the exterior surface thereof; a drive gear 255; and, an insert 258. As best shown in FIG. 5, drive gear 255 includes a plurality of gear teeth that engage second gear rack 226, as well as a curved arm 256 that terminates in a structure referred to as a pawl. Bottom pawl 257 engages the bottom portion of spokes 252 and rotates body 251 in a clockwise manner. Insert 258 sits in the top portion of body 251 and includes a curved arm 259 that also terminates in a pawl. Top pawl 260 engages the top portion of spokes 252 and in combination with bottom pawl 257 prevents drive wheel assembly 250 from rotating backwards due to reverse tension experienced by drive wheel assembly 250 when adhesive dots 410 make contact with the surface on which they are to be deposited. Thus, by these means, the tape on supply roll 400 does not pull out of dispenser 100 when the device is in use. Pin 261 is inserted into second support 144 and secures the entire drive wheel assembly thereto. In the exemplary embodiment, there are five pairs of tractive pins formed on the exterior of body 251 and these pins cooperate with holes 412, which are formed in tape supply roll 400 to incrementally advance the tape through adhesive dispensing system 10. Other pin configurations are possible. In the exemplary embodiment, an optional guide wheel 270 is mounted on third support 146 and held in place by pin 271. Guide wheel 270 assists in guiding the tape from tape supply roll 400 through adhesive dispensing system 10.

With reference to FIGS. 4B and 5, take-up wheel assembly 280, which receives and stores spent tape from tape supply roll 400, includes a hub 281 that further includes a flange 286. A removable cylindrical collar 287 having a flattened portion on one side is mounted on hub 281. Flange 286 and collar 287 cooperate to secure an end portion of tape supply roll 400 when dispenser 100 is loaded and ready for use. A pin 296 secures take-up wheel assembly 280 to support fourth support 148. Hub 281 includes a plurality of exterior ratchet teeth 282 (see FIG. 4B) and a plurality of interior gear teeth 283 (see FIG. 5). Exterior ratchet teeth 282 cooperate with second latch 295 to prevent unwanted backwards rotation of take-up wheel assembly 280 when dispenser 100 is in use. Interior gear teeth 283 engage detents 291, which are formed on ring 290, which is part of first bottom gear 288. As shown in FIG. 5, first bottom gear 288 is positioned within the underside of base 281 and further includes a plurality of ratchet teeth 289. Second bottom gear 292 is positioned within the center portion of first bottom gear 288 and includes a plurality of gear teeth 293 and two curved arms 294. The terminal portions of arms 294 engage ratchet teeth 289 on first bottom gear 288 and form a one-way coupling that permits unidirectional movement take-up wheel assembly 280. Thus, as plunger 210 is depressed and drive bar 220 moves in response, first gear rack 225 engages gear teeth 293 and rotates take-up wheel assembly 280 in a clockwise manner. In this embodiment, a friction coupling exists between hub 281 and first bottom gear 288 and provides a mechanical means by which take-up wheel assembly 280 can function properly with a small amount of spent tape stored thereon or up to an entire roll of spent tape stored thereon. The detents 291 on the outside edge of ring 290 engage interior gear teeth 283 in a non-rigid manner that provides for a certain degree of slippage between hub 281 and first bottom gear 288. The degree of slippage increases as more spent tape is stored on hub 281. For example, hub 281 may rotate as much as one-third of a complete turn when take-up wheel assembly 280 is empty, but may decrease to as a little as one-eighth of a turn when fully loaded with spent tape.

As shown in FIGS. 3A, 4A and C, and 5, shroud 300 is a unitary piece that mounts within first body portion 104 and performs several functions, in addition to enhancing the aesthetic qualities of dispenser 100 by hiding much of the mechanical structure of the device. Shroud 300 also guides tape from tape supply roll 400 through dispenser 100 and provides a means for creating pressure against the bottom surface 406 of the tape from tape supply roll 400 when adhesive is being dispensed. Shroud 300 includes a contoured body 302 that further includes a top portion 304 and a bottom portion 306. Applicator 307 includes an anvil 308 formed at one end of shroud 300 and a foam pad 310 attached thereto for allowing force to be applied evenly across the surface of the unit of adhesive. A first aperture 312 is adapted to receive screw 314, which is used to secure shroud to sixth post 130. A second aperture 318, third aperture 322, fourth aperture 326, and fifth aperture 332 are formed in body 302 and accommodate various components of drive system 200, including supply wheel assembly 240. Top portion 304 includes tape guide 316, top collars 324 and 328. Bottom portion 306 includes bottom collars 320, 324, 330, and 336, as well as pins 338, the placement of which corresponds to the placement of first post 120, second post 122, third post 124, fourth post 126, and fifth post 128 in first housing portion 104.

As shown in FIG. 6, tape supply roll 400, and cardboard or plastic core 408 around which a length of tape has been coiled or wound. The length of tape comprises a substrate in the form of a release liner 402 (e.g., waxed or coated paper) upon which a plurality of discrete adhesive units or subunits in the form of dots or other geometric shapes has been deposited. Release liner 402 includes a top release surface 404 and a bottom release surface 406. The adhesive units are typically thin individual units or multiple subunits of double-sided tape or other adhesive material that have been positioned sequentially in a linear fashion along top release surface 404 or in some embodiments, bottom release surface 406. At least one tractive aperture or hole 412 is formed in release liner 402 between each adhesive unit 410 in the manner depicted in FIG. 6. The spacing of each hole 412 relative to the other holes corresponds to the placement each pair of tractive pins 253 formed on body 251 of drive wheel assembly 250. In the exemplary embodiment, each pair of tractive holes 412 shown in FIG. 6 cooperates with a pair of tractive pins to incrementally advance the tape a fixed distance through the system. The adhesive units and/or subunits deposited on release liner 402 may include single or double-sided tape, thermoplastic adhesives, stickers or other adhesive materials.

Figure 2:
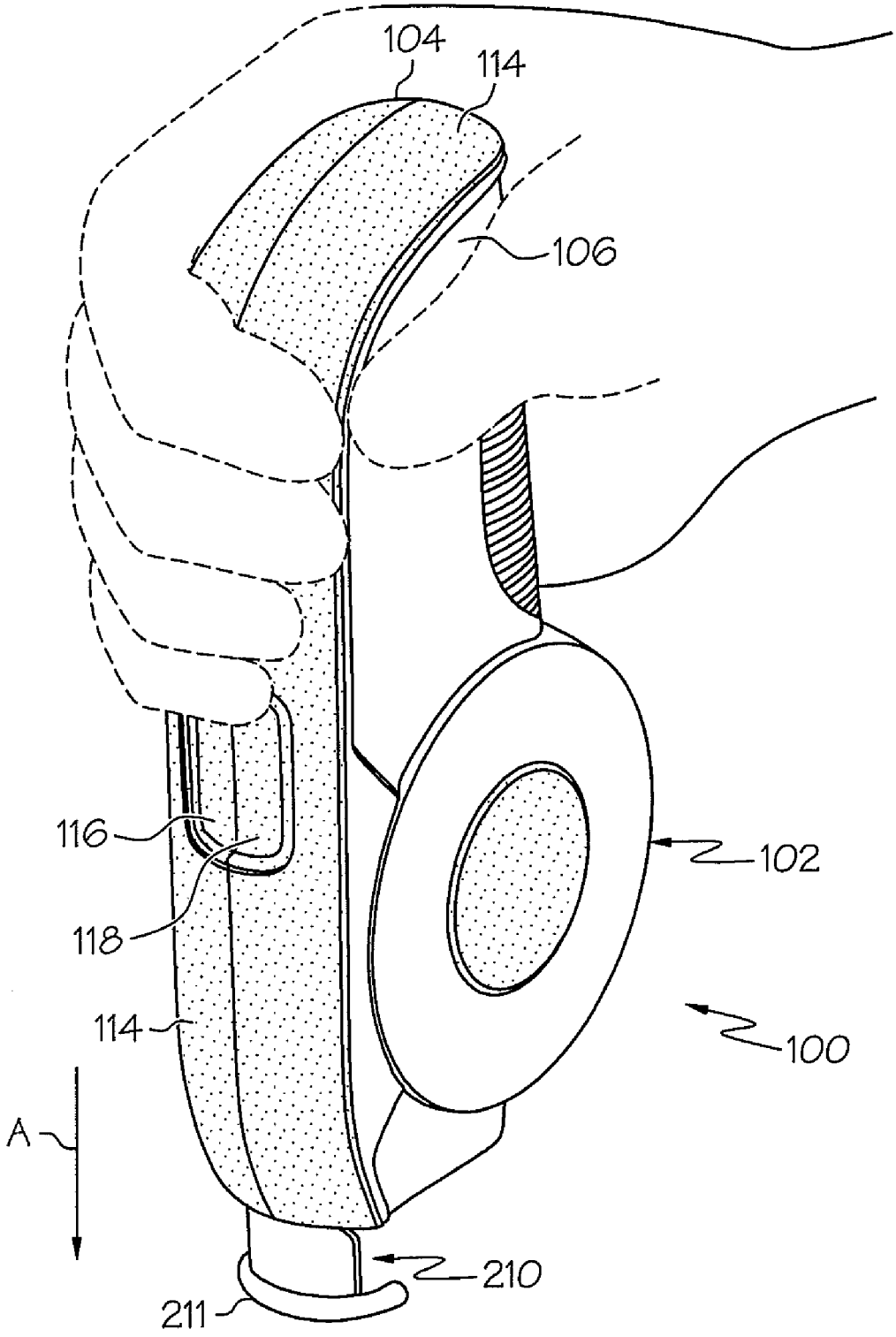
FIG. 2 is a top perspective view of the hand-held adhesive dispenser illustrated in FIG. 1.

The various components of dispenser 100, which are typically plastic, metal or combinations thereof, can be manufactured and/or fabricated using any number of known manufacturing and fabrication methods techniques. Once assembled, dispenser 100 may be used to dispense individual adhesive dots onto a surface material such as paper, poster board, photo album pages or the like. A user of dispenser 100 first opens the device, places a properly oriented tape supply roll 400 onto supply wheel assembly 240, feeds a length of tape through the device and across tractive pins 253 (see FIG. 7), secures the end of the tape to take up wheel assembly 280, and closes the housing 102. Next, the user positions the device as shown in FIG. 2 and presses downward against the surface upon which adhesive is to be deposited. Plunger 210 retracts into housing 102 bringing pad 310 into contact with the surface and dispensing a unit of adhesive thereon. Simultaneously, the movement of drive bar 220, which is mechanically coupled with plunger 210, advances drive wheel assembly 250 a fixed distance, thereby moving the next unit of adhesive into position below anvil 308. This occurs each time dispenser 100 is actuated until all of the adhesive units have been dispensed. Spent tape is stored on take-up wheel assembly 280 until tape supply roll 400 is depleted and replaced.

In other embodiments of this invention, supply wheel assembly 240 may be entirely absent, and a simple post, flange, open mounting surface or area or other support means may be provided for supporting tape supply role 400 or simply allowing it to sit within dispenser 100. Take-up wheel assembly 280 may be replaced by a simple slot or opening formed in housing 102 for allowing spent tape to simply exit the housing where it may be torn off and discarded. In some embodiments of the present invention, guide wheel 270 is absent from dispenser 100 and in some embodiments, latches 245 and 295 are absent from the dispenser.

While the present invention has been illustrated by the description of exemplary embodiments thereof, and while the embodiments have been described in certain detail, it is not the intention of the Applicant to restrict or in any way limit the scope of the appended claims to such detail. Additional advantages and modifications will readily appear to those skilled in the art. Therefore, the invention in its broader aspects is not limited to any of the specific details, representative devices and methods, and/or illustrative examples shown and described. Accordingly, departures may be made from such details without departing from the spirit or scope of the applicant's general inventive concept.

What is claimed:

1. A system for dispensing adhesive, comprising:

(a) a dispenser having a housing, wherein the dispenser further includes:

(i) a drive mechanism, and wherein the drive mechanism further includes:

(A) an actuator for actuating the dispenser; and (B) a drive bar adapted to cooperate with the actuator, wherein the drive bar further includes:

a) a first toothed portion, b) a second toothed portion, and c) a protrusion formed near the front end of the drive bar;

(C) a drive wheel assembly, wherein the drive wheel assembly further includes: a drive wheel adapted to mechanically engage the second toothed portion of drive bar and mechanical means for limiting reverse rotation of the drive wheel when the dispenser is in use, and wherein the drive wheel further includes a plurality of tractive pins, (D) a first biasing member disposed between the actuator and the drive bar, and a second biasing member disposed between the drive bar and a portion of the housing; and (ii) a supply wheel assembly mounted within the housing, wherein the supply wheel assembly further includes: a supply wheel adapted to receive a quantity of discrete units of adhesive releasably deposited on a substrate, and mechanical means for limiting reverse rotation of the supply wheel when the dispenser is in use, and wherein the mechanical means for limiting reverse rotation of the supply wheel further includes a plurality of ratchet teeth formed on the supply wheel and a first latch mounted with the housing, wherein the first latch cooperates with the protrusion on the drive bar;

(iii) a take-up wheel assembly mounted within the housing, wherein the take-up wheel assembly further includes: a take-wheel adapted to mechanically engage the first toothed portion of the drive bar and further adapted to receive the substrate following deposition of a discrete unit of adhesive, and mechanical means for limiting reverse rotation of the take-up wheel when the dispenser is in use, and wherein the mechanical means for limiting reverse rotation of the take-up wheel further includes a plurality of ratchet teeth formed on the take-up wheel and a second latch mounted with the housing; and (b) the quantity of discrete units of adhesive releasably deposited on a substrate, wherein the substrate is mounted on the supply wheel within the dispenser, and wherein the substrate further includes means for cooperating with the tractive pins on the drive wheel to advance the substrate a substantially fixed, predetermined distance upon actuation of the dispenser.

2. The system of claim 1, wherein the take-up wheel further comprises a friction coupling for allowing the take-up wheel to store increasing amounts of the substrate as the discrete units of adhesive are dispensed.

3. The system of claim 1, wherein the housing is hinged for allowing easy access to the interior of the dispenser.

4. The system of claim 1, wherein the discrete units of adhesive further comprise single units or multiple subunits of double-sided adhesive material.

5. The system of claim 1, wherein the means for cooperating with the tractive pins on the drive wheel further comprise a plurality of apertures for engaging the tractive pins on the drive wheel, and wherein the plurality of apertures are formed in the substrate at predetermined distances from one another.

6. An adhesive dispenser, comprising:

(a) a housing;

(b) a drive mechanism, and wherein the drive mechanism further includes:

(i) an actuator for actuating the dispenser;

(ii) a drive bar adapted to cooperate with the actuator, wherein the drive bar further includes:

(A) a first toothed portion, (B) a second toothed portion, and (C) a protrusion formed near the front end of the drive bar;

(iii) a drive wheel assembly, wherein the drive wheel assembly further includes: a drive wheel adapted to mechanically engage the second toothed portion of the drive bar and mechanical means for limiting reverse rotation of the drive wheel when the dispenser is in use, and wherein the drive wheel further includes a plurality of tractive pins, (iv) a first biasing member disposed between the actuator and the drive bar, and a second biasing member disposed between the drive bar and a portion of the housing; and (c) a supply wheel assembly mounted within the housing, wherein the supply wheel assembly further includes: a supply wheel adapted to receive a quantity of discrete units of adhesive releasably deposited on a substrate, and mechanical means for limiting reverse rotation of the supply wheel when the dispenser is in use, and wherein the mechanical means for limiting reverse rotation of the supply wheel further includes a plurality of ratchet teeth formed on the supply wheel and a first latch mounted with the housing, wherein the first latch cooperates with the protrusion on the drive bar; and (d) a take-up wheel assembly mounted within the housing, wherein the take-up wheel assembly further includes: a take-wheel adapted to mechanically engage the first toothed portion of the drive bar, and mechanical means for limiting reverse rotation of the take-up wheel when the dispenser is in use, and wherein the mechanical means for limiting reverse rotation of the take-up wheel further includes a plurality of ratchet teeth formed on the take-up wheel and a second latch mounted with the housing.

7. The dispenser of claim 6, wherein the housing further comprises a first portion, a second portion, and hinge means for connecting the first portion to the second portion.

8. The dispenser of claim 6, wherein the housing further comprises at least one textured gripping portion and at least one non-slip gripping portion.

9. The dispenser of claim 6, wherein the take-up wheel further includes a friction coupling for allowing the take-up wheel to store increasing amounts of the substrate.

* * * * *